United States Patent [19]

Ruger

[11] Patent Number: 4,771,562

[45] **Date of Patent: * Sep. 20, 1988**

[54] GRIPS FOR HANDGUNS

[75] Inventor: William B. Ruger, Croydon, N.H.

[73] Assignee: Sturm, Ruger & Company, Inc., Southport, Conn.

[ * ] Notice: The portion of the term of this patent subsequent to Dec. 2, 2003 has been disclaimed.

[21] Appl. No.: 937,464

[22] Filed: Dec. 2, 1986

Related U.S. Application Data

[63] Continuation-in-part of Ser. No. 716,920, Mar. 28, 1985, Pat. No. 4,625,445.

[51] Int. Cl.[4] ..... F41C 23/00

[52] U.S. Cl. ..... 42/71.02

[58] Field of Search ..... 42/71.01, 71.02, 74

[56] References Cited

U.S. PATENT DOCUMENTS

| | | | |
|---|---|---|---|
| 2,308,627 | 1/1943 | Rickenbacher | 42/71.02 |
| 4,132,024 | 1/1979 | Pachmayr et al. | 42/71.02 |
| 4,346,530 | 8/1982 | Stewart et al. | 42/71.02 X |

*Primary Examiner*—Ted L. Parr

*Attorney, Agent, or Firm*—Pennie & Edmonds

[57] ABSTRACT

A handgun handle construction including a handle frame, elastomer grip element portions positioned on the sides, including as desired on the front and back sides, of the handle frame. The elastomer grip element portions have recesses to each receive a non-deformable insert element. Fasteners hold the frame, grip element portions and inserts together.

6 Claims, 19 Drawing Sheets

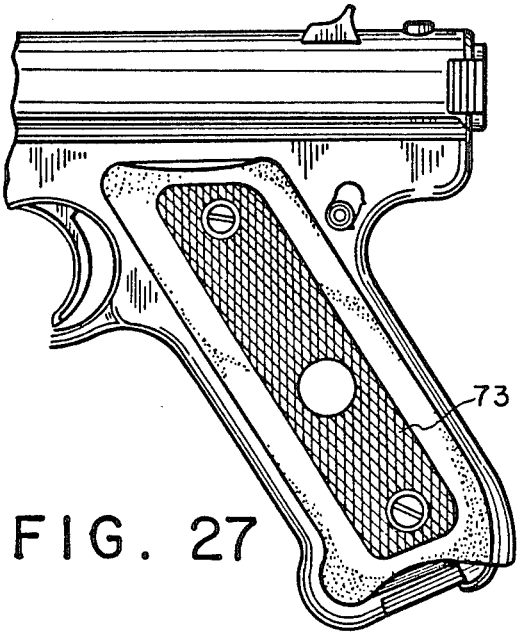
FIG. 27
FIG. 26
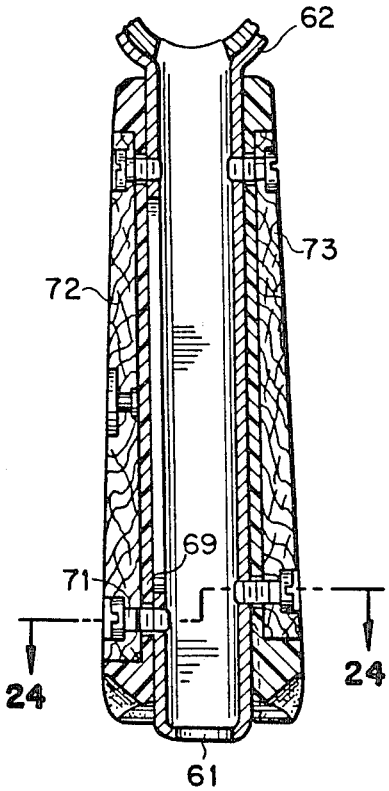
FIG. 24
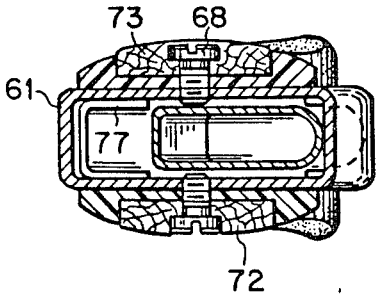
FIG. 25
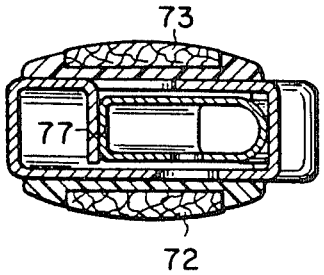

GRIPS FOR HANDGUNS

This is a continuation-in-part, of application Ser. No. 716,920, filed Mar. 28, 1985, U.S. Pat. No. 4,625,445.

BACKGROUND OF THE INVENTION

Numerous handgun grip arrangements have been proposed including the use of resilient grip panels with and without internal stiffening members embedded in such panels. Rubber grip panels and wood grip panels of various sizes and shapes have been used over the years.

None of the prior grip arrangements has provided satisfactory gripping by the operator together with an acceptable appearance, versatility and simplicity of design, combined with ease of manufacture.

SUMMARY OF THE INVENTION

Broadly, the present invention provides a novel grip arrangement for handguns in which elastomer grip elements are positioned on each side of the handle frame. The elastomer grip elements (which may be spaced-apart or urgedly engaged or integrally formed) have recesses formed in them to receive non-deformable externally inserted stiffening elements. Fasteners are used to secure the elastomer grip elements and externally inserted stiffening elements to each other and to the handle frame.

It is a feature of the invention that the externally inserted stiffening elements are shaped and sized to be capable of being gripped by the handgun operator to move these externally inserted stiffening elements toward the handle frame thus deforming the resilient grip elements and providing a firm and comfortable grip for the handgun operator. The externally inserted stiffening elements further add to the functionality and appearance of the firearm, and the grips so constructed offer the advantages of superior cushioning against recoil and comfortable gripping surfaces for the shooter.

BRIEF DESCRIPTION OF DRAWINGS

FIG. 24 is a sectional view taken along the line 24—24 of FIG. 22;

FIG. 25 is a sectional view taken along the line 25—25 of FIG. 22;

FIG. 26 is a sectional view taken along the line 26—26 of FIG. 22;

FIG. 27 is a left-hand elevational view of the handle of the automatic pistol;

DESCRIPTION OF THE PREFERRED EMBODIMENT

Figure 1:
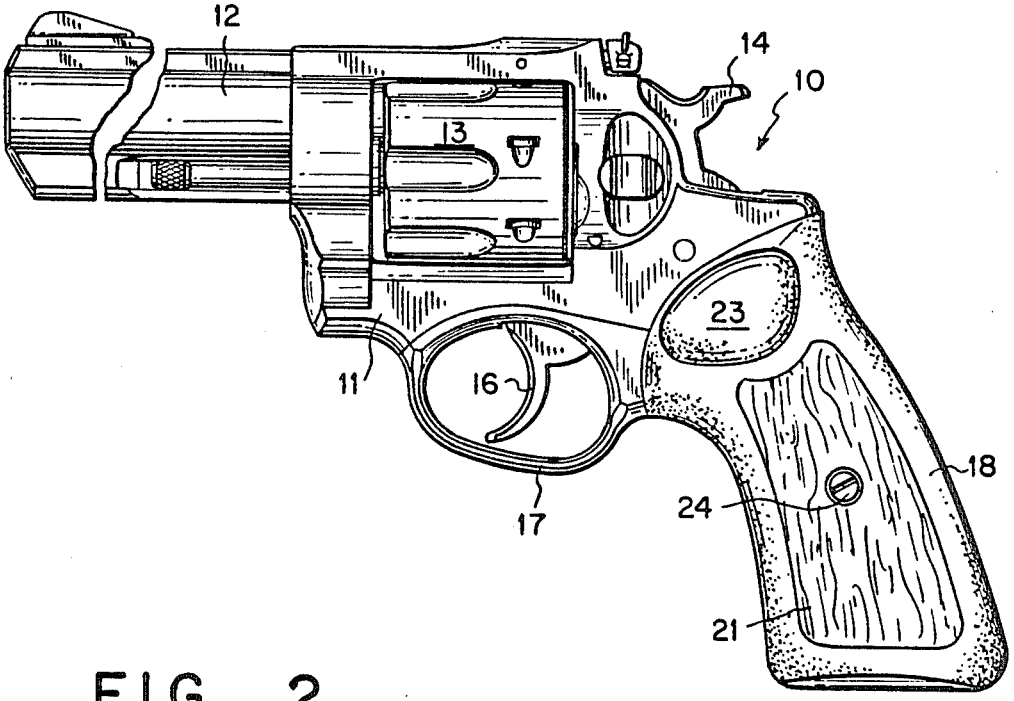
FIG. 1 is a left side partial elevational view of a revolver including the present invention.
Figure 2:
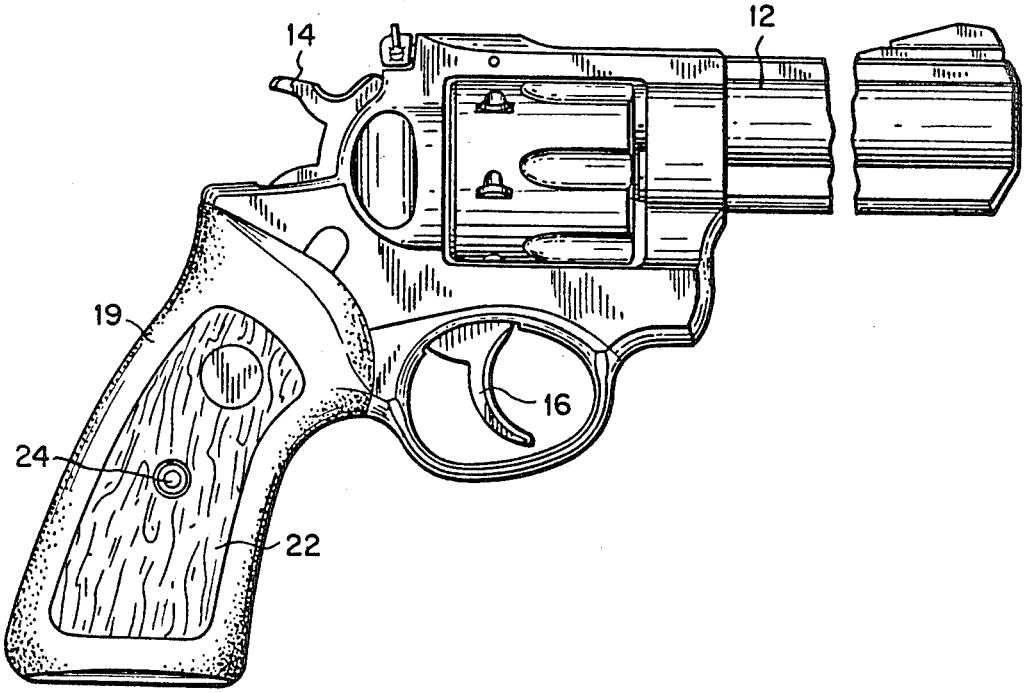
FIG. 2 is a right side partial elevational view of the revolver.
Figure 3:
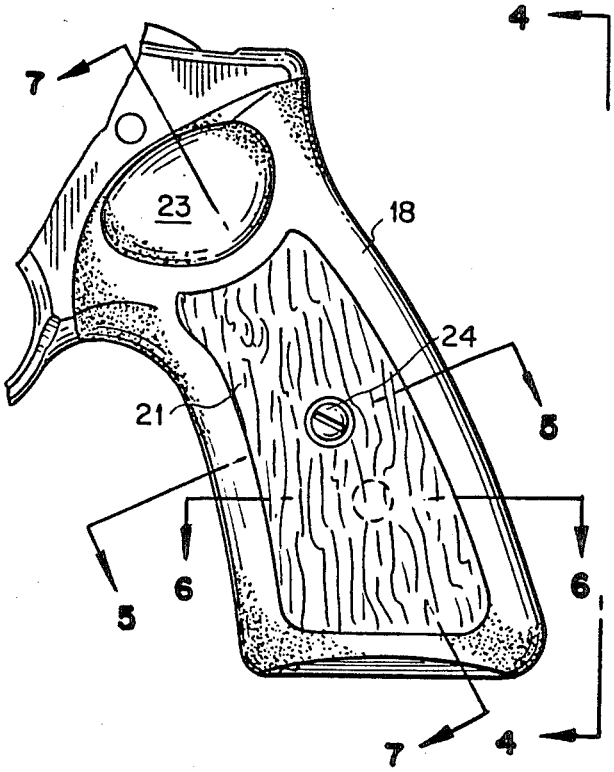
FIG. 3 is a right side elevational view of the handle of the revolver.
Figure 4:
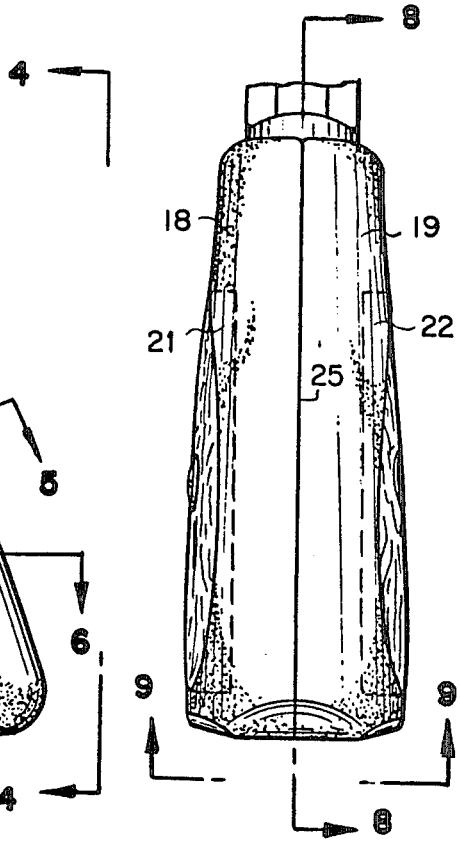
FIG. 4 is a rearward elevational view of the handle of the revolver.
Figure 5:
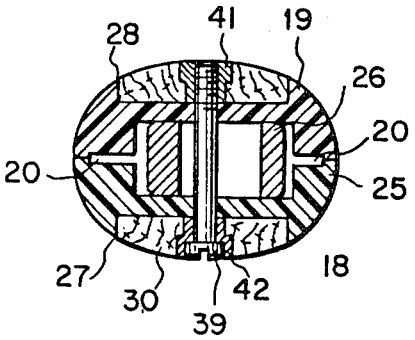
FIG. 5 is a sectional view taken along the line 5—5 of FIG. 3.
Figure 6:
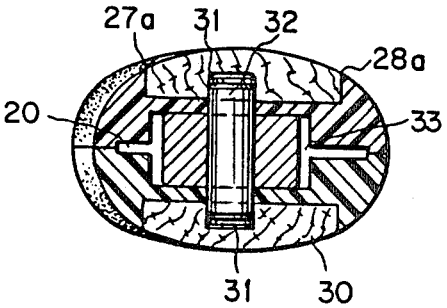
FIG. 6 is a sectional view taken along the line 6—6 of FIG. 3.

Turning to FIGS. 1-3, revolver 10 includes frame 11, barrel 12, cylinder 13, hammer 14, trigger 16, trigger guard 17, left grip panel 18, right grip panel 19, left grip panel insert 21 and right grip panel insert 22. Also shown are left panel depression area 23 and grip panel fastener 24.

In FIGS. 4-20, it is seen that each grip panel 18, 19 is made of an elastomer or otherwise deformable material and sized and shaped including notches 20 to abut along narrow abutment surface 25 and to thereby surround handle frame 26. Grip panels 18, 19 each has in it a recess 27, 28 respectively. Recesses 27, 28 each extend a substantial distance up and down and a substantial distance across each panel 18, 19 and each recess 27, 28 receives a grip panel inserts 21, 22 respectively. Panel inserts 21, 22 are made of a stiff material such as wood to provide more rigidity and a more pleasing appearance to the handle system which includes handle frame 11, grip panels 18, 19, panel inserts 21, 22 and the fastener arrangement 24 to hold them together. The size and shape of the recesses 27, 28 and the inserts 21, 22 housed in them may be varied to control the resilience, stiffness, and appearance of a particular handle system.

Alignment of panel inserts is further controlled by the tolerance between the recess edges 27*a*, 28*a* and the sides of the panel inserts 21, 22. In addition, alignment of both panels 18, 19 and inserts 21, 22 is aided by alignment recesses holes 30 in the panels 18, 19 and insert openings 31 in the inserts 21, 22 which holes and openings receive stud 32 affixed to handle frame 26 (see FIG. 10). Stud 32 prevents turning or twisting of the grip elements around fastener arrangement 24.

Handle frame 26 is preferably substantially smaller than the grip panels 18, 19 permitting substitution of smaller or larger panels as desired. Where larger panels are used which extend below the frame handle 26, the size and shape of the insert design will permit obtaining the desired flexibility-to-stiffness of the system. For example, a man with a large hand and a strong grip may wish a larger or stiffer insert as compared to a woman with a smaller hand and a less strong grip.

Figure 8:
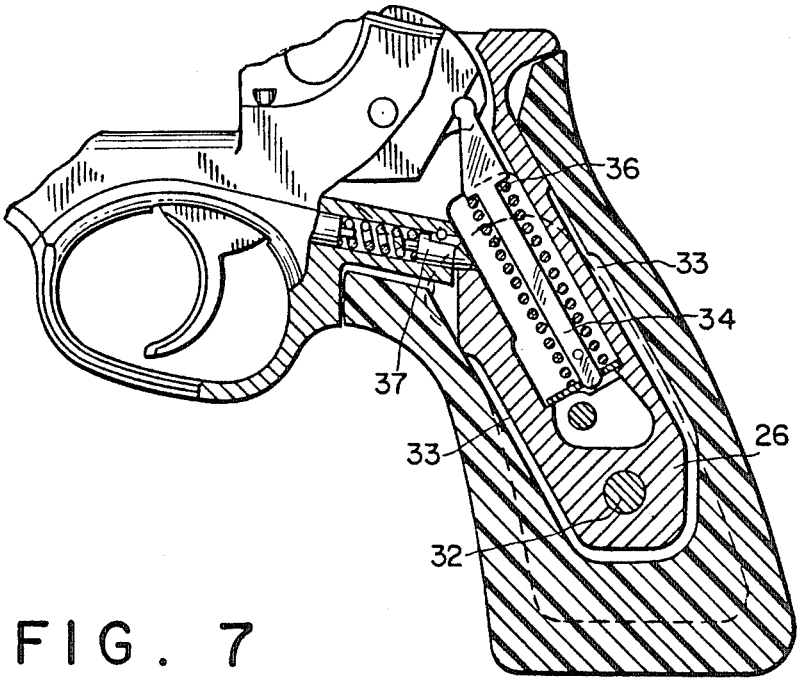
FIG. 8 is a sectional view taken along the line 8—8 of FIG. 4.
Figure 7:
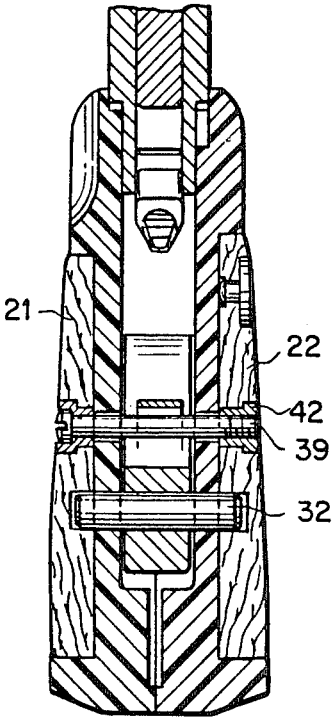
FIG. 7 is a sectional view taken along the line 7—7 of FIG. 4.
Figure 9:
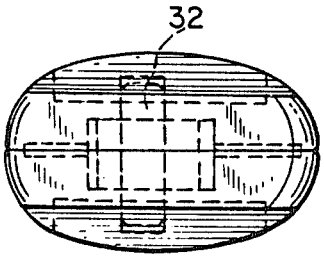
FIG. 9 is a view taken along line 9—9 of FIG. 4.
Figure 10:
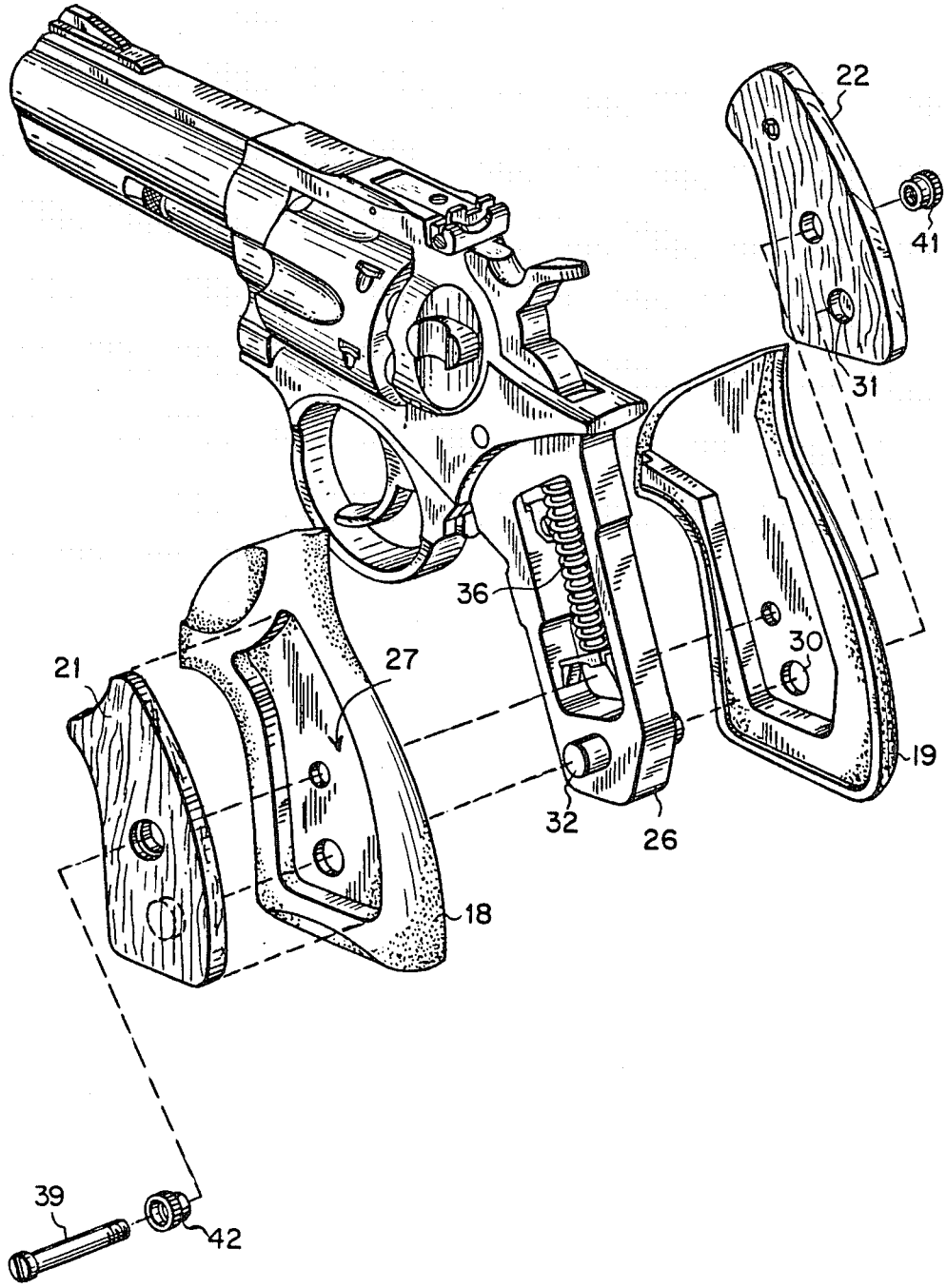
FIG. 10 is an exploded perspective view of the revolver including the handle.

Handle frame 26 and panels 18, 19 are shaped to provide space 33 in front of and behind handle frame 26 (see FIGS. 7, 8). Hammer strut 34, hammer spring 36 and spring-loaded trigger guard latch mechanism 37 is also shown (FIG. 8). Fastener 24 includes bolt 39, nut 41 and washer 42.

Turning to FIGS. 11-15, the second embodiment of the invention includes revolver 40 in which the grip panels 18', 19' do not engage but instead are separated by the handle frame 26'. Further the grip panels 18', 19' each include a second inner recess 43, 44 (positioned opposite outer recesses 27', 28') to provide for right and left spaces 46, 47 between the panels 18', 19' and the handle frame 26'. The purpose and function of inserts 21', 22', fasteners 24' and alignment stud 32' are the same as in the earlier described embodiment.

With attention to FIGS. 16-21, the third embodiment is shown adapted for another style of revolver known as the "single action" type. This embodiment shows revolver 50 in which second inner recesses 43', 44' are slightly larger than in the earlier second embodiment. Handle frame 26' includes frame opening 49. All other aspects of the invention are similar to the second embodiment.

With attention now to FIGS. 22-27, an automatic pistol 60 is shown with handle 61 including handle frame 62, flexible grip members 63, 64 and rigid inserts 66, 67. Fasteners 68 pass through holes 69 in the grip members 63, 64 and through holes 71 and the grip inserts 72, 73 for threaded engagement in threaded holes 74 in grip handle frame 76 to avoid interference with the magazine 77. Fasteners 68 are recessed in inserts 72, 73. Also shown is barrel 79, bolts 80 and 81 handle frame release lever.

Turning to FIGS. 28-34 a fifth embodiment is seen in which pistol 90 carries the same handle grip construction as pistol 70 except the flexible grip panels 81, 82 are secured to grip handle frame 83 by lower fasteners 84 which engage notches 86, 87 in the lower ends of panels 81, 82, respectively. The handle construction of pistol 80 further differs in that rigid inserts 88, 89 carry tapered end portions 91, 92 which fit into complementary panel notches 93, 94.

Figures 11, 12:
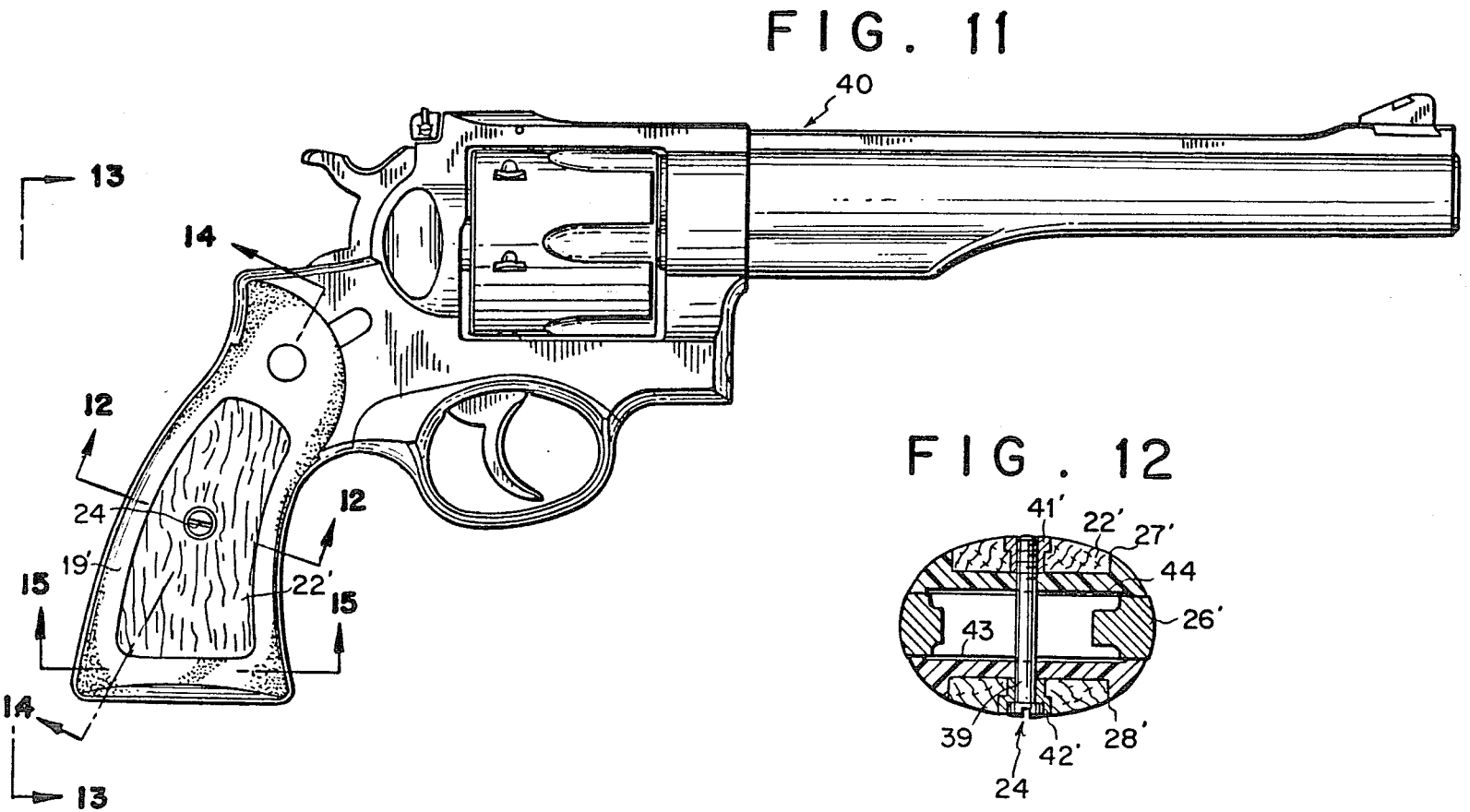
FIG. 11 is a right hand elevational view of a first modification of the invention as applied to a revolver.
FIG. 12 is a sectional view taken along the line 12—12 of FIG. 11.
Figure 13:
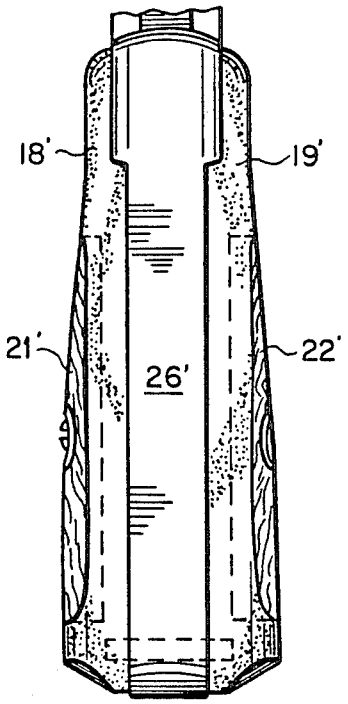
FIG. 13 is a view taken along the line 13—13 of FIG. 11.
Figure 14:
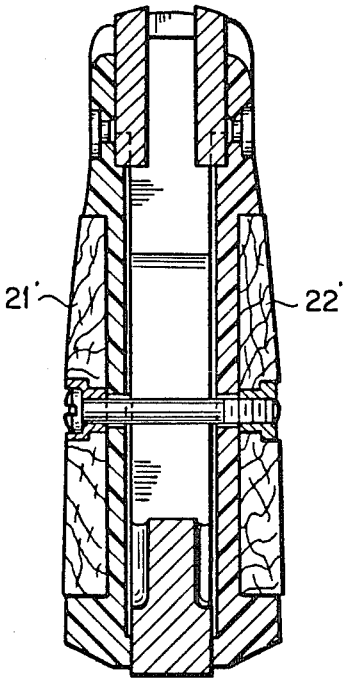
FIG. 14 is a sectional view taken along the line 14—14 of FIG. 11.
Figure 15:
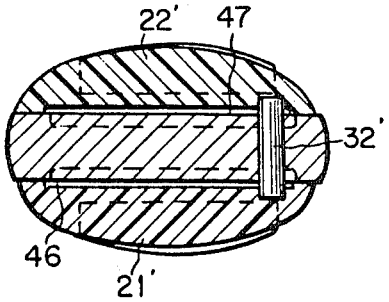
FIG. 15 is a sectional view taken along the line 15—15 of FIG. 11.
Figures 16, 17, 18:
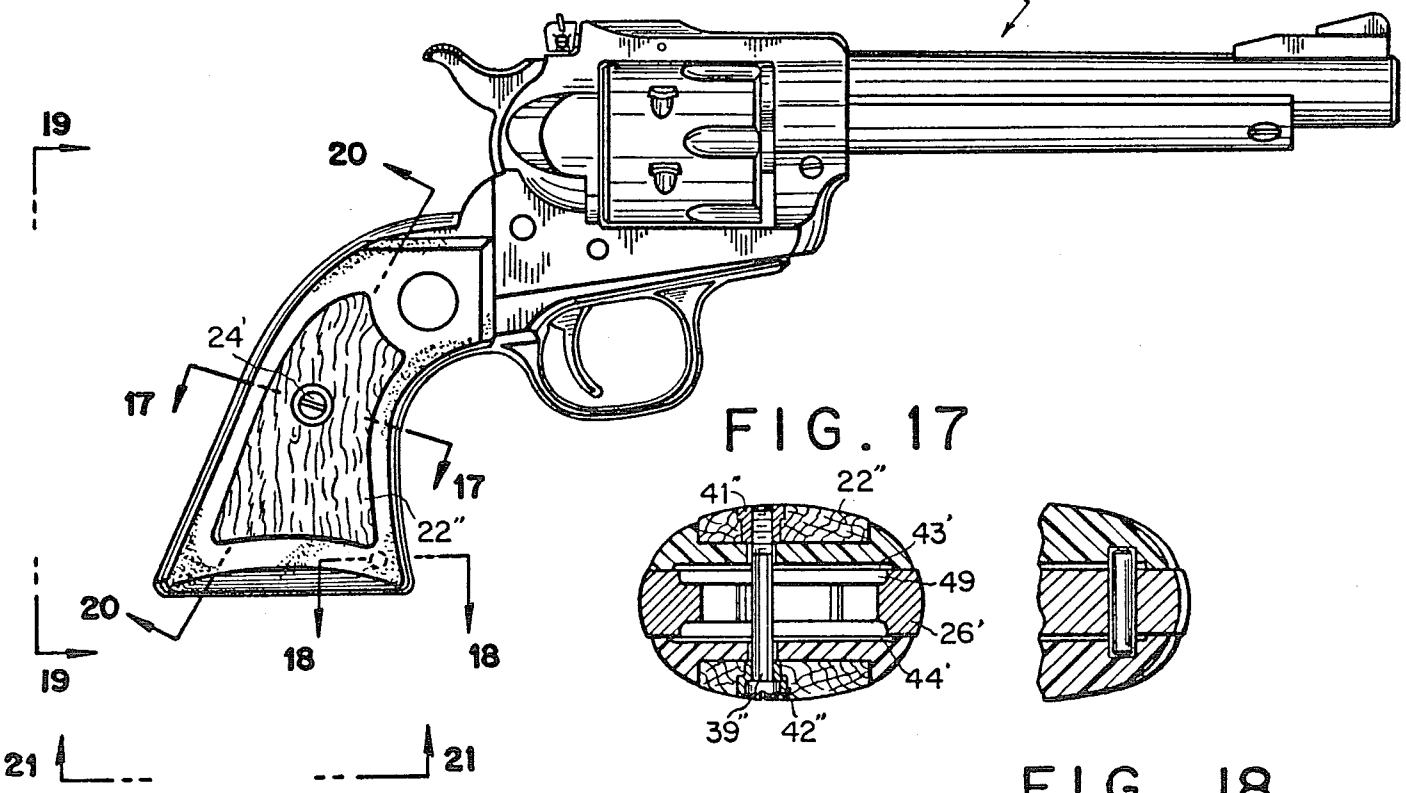
FIG. 16 is a second modification of the present invention as applied to a revolver.
FIG. 17 is a sectional view taken along the line 17—17 of FIG. 16.
FIG. 18 is a sectional view taken along the line 18—18 of FIG. 16.
Figure 19:
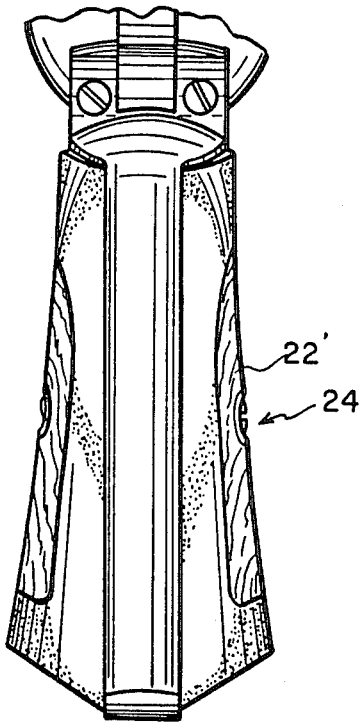
FIG. 19 is a view taken along the line 19—19 of FIG. 16.
Figure 20:
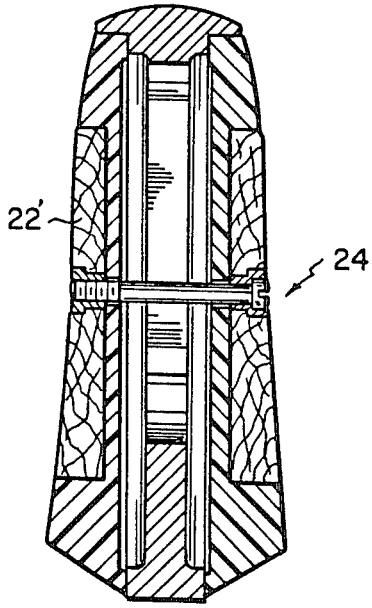
FIG. 20 is a sectional view taken along the line 20—20 of FIG. 16.
Figure 21:
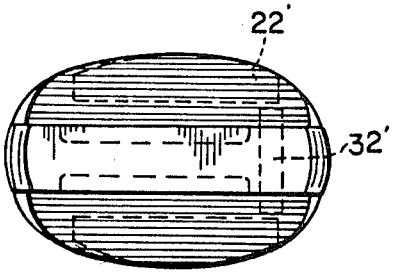
FIG. 21 is a view taken along the line 21—21 of FIG. 16.
Figure 22:
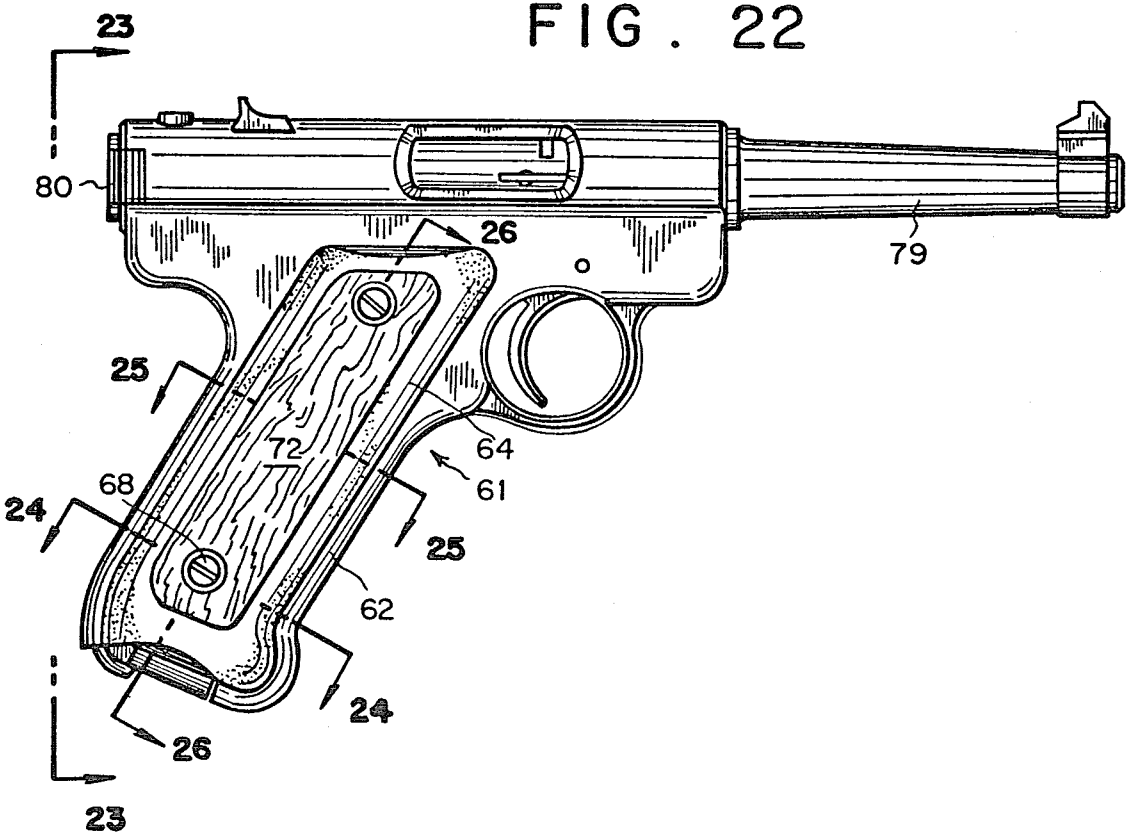
FIG. 22 is a third modification of the invention as applied to an automatic pistol.
Figure 23:
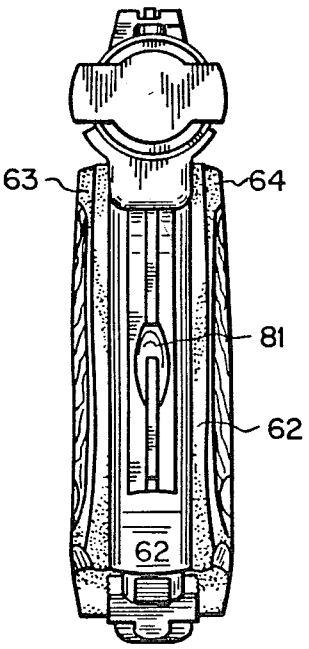
FIG. 23 is a view taken along the line 23—23 of FIG. 22.
Figure 30:
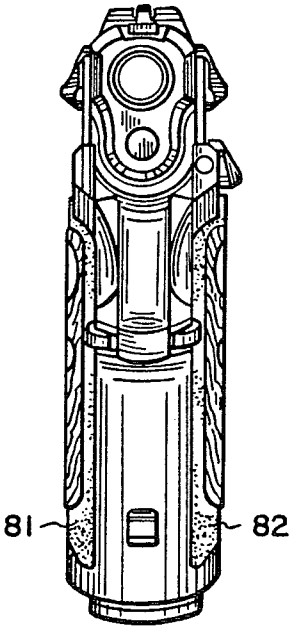
FIG. 30 is a frontal elevational view of the automatic pistol of FIG. 28.
Figure 28:
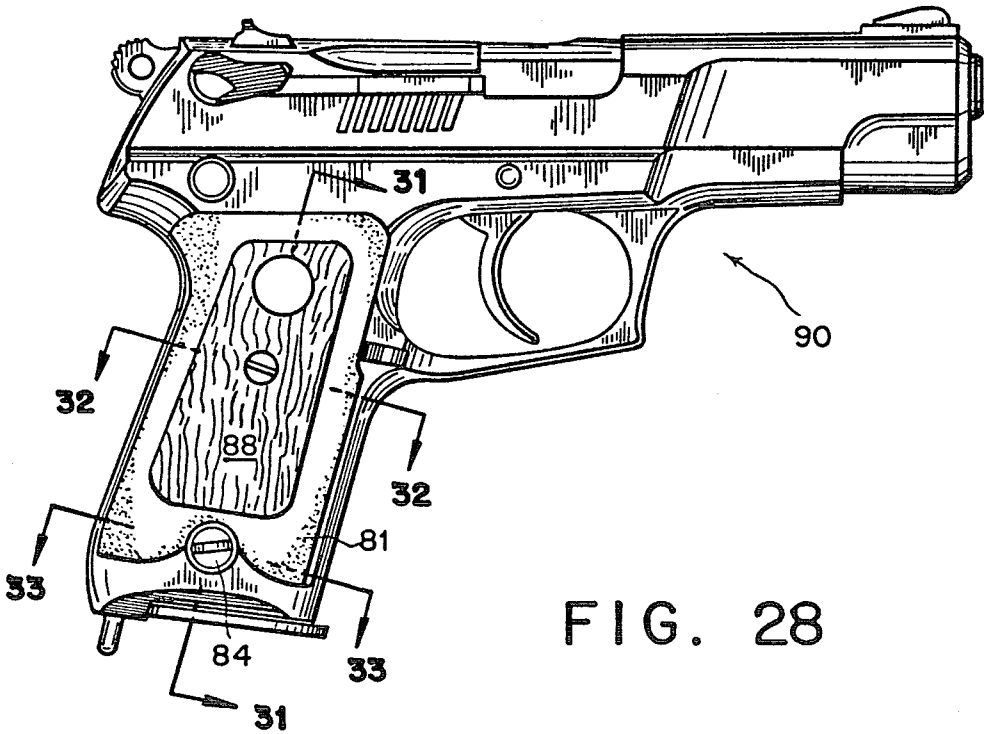
FIG. 28 is a fourth modification of the invention as applied to another automatic pistol.
Figure 29:
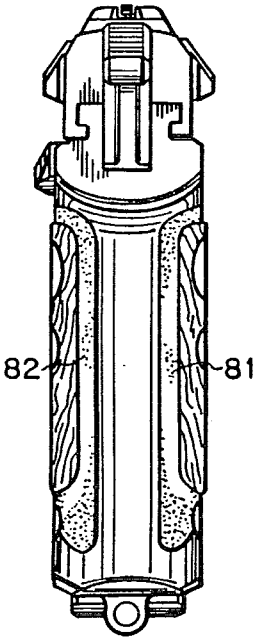
FIG. 29 is a rearward elevational view of the automatic pistol of FIG. 28.
Figure 31:
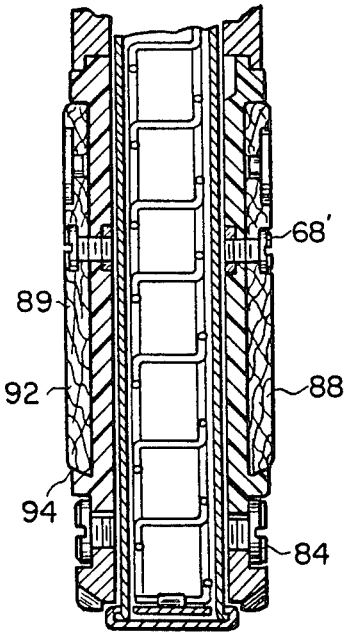
FIG. 31 is a sectional view taken along the line 31—31 of FIG. 28.
Figure 34:
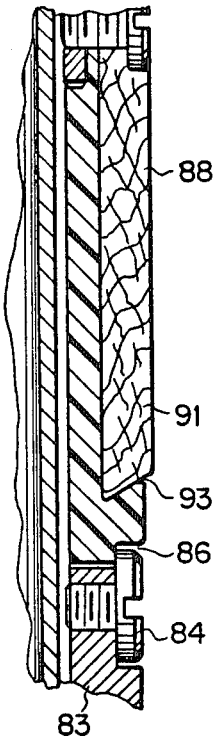
FIG. 34 is an enlarged view of a portion of FIG. 31.
Figure 33:
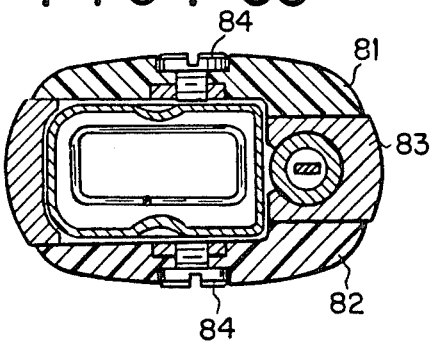
FIG. 33 is a sectional view taken along the line 33—33 of FIG. 28.
Figure 32:
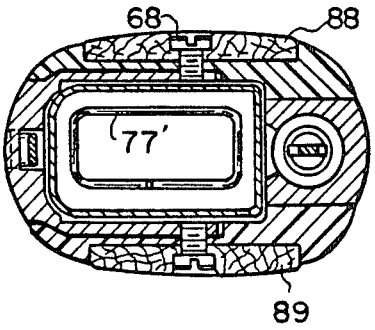
FIG. 32 is a sectional view taken along the line 32—32 of FIG. 28.
Figure 35:
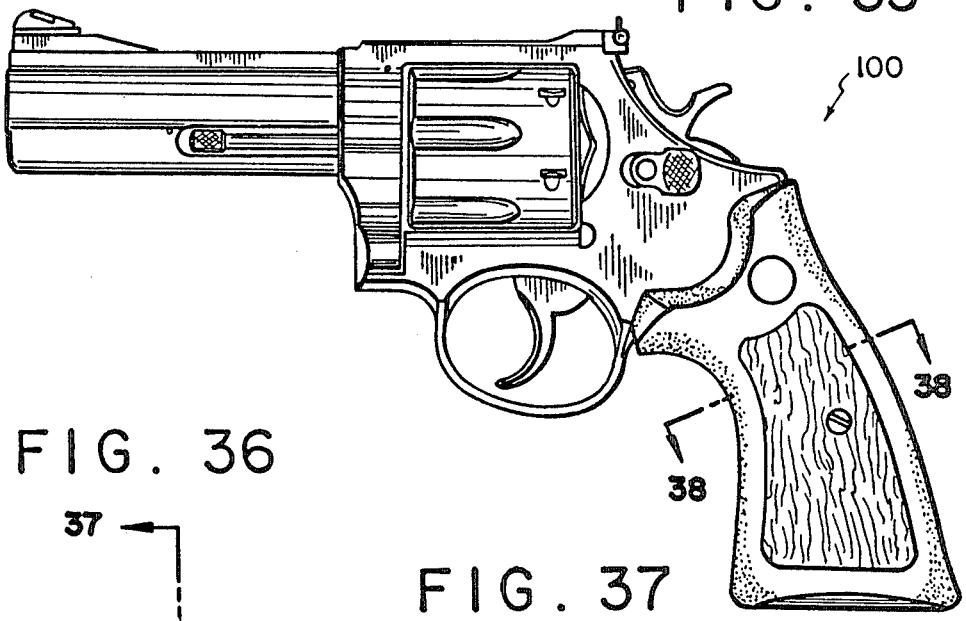
FIG. 35 is a left-hand side elevational view of a fifth modification as applied to a revolver.
Figure 36:
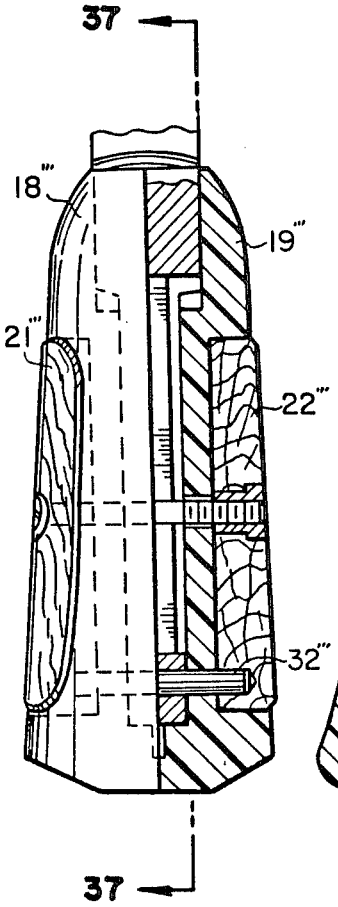
FIG. 36 is, on its left half, a rearward view of the revolver of FIG. 35 and on its right half a sectional view.
Figure 37:
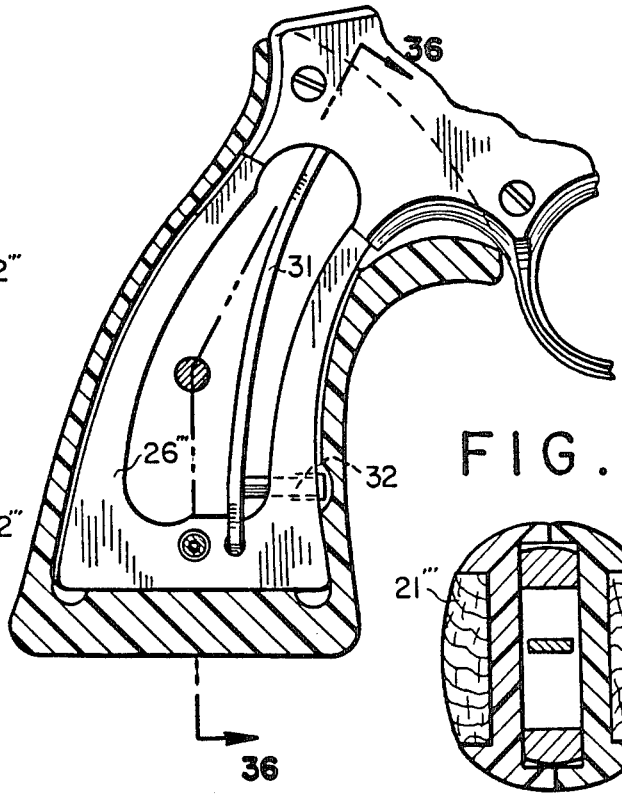
FIG. 37 is a sectional view taken along the line 37—37 of FIG. 36.
Figure 38:
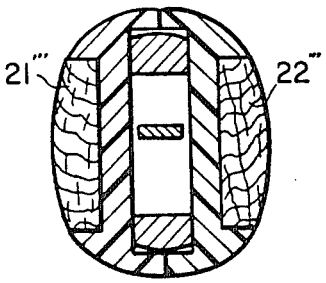
FIG. 38 is a sectional view taken along line 38—38 of FIG. 35.
Figure 39:
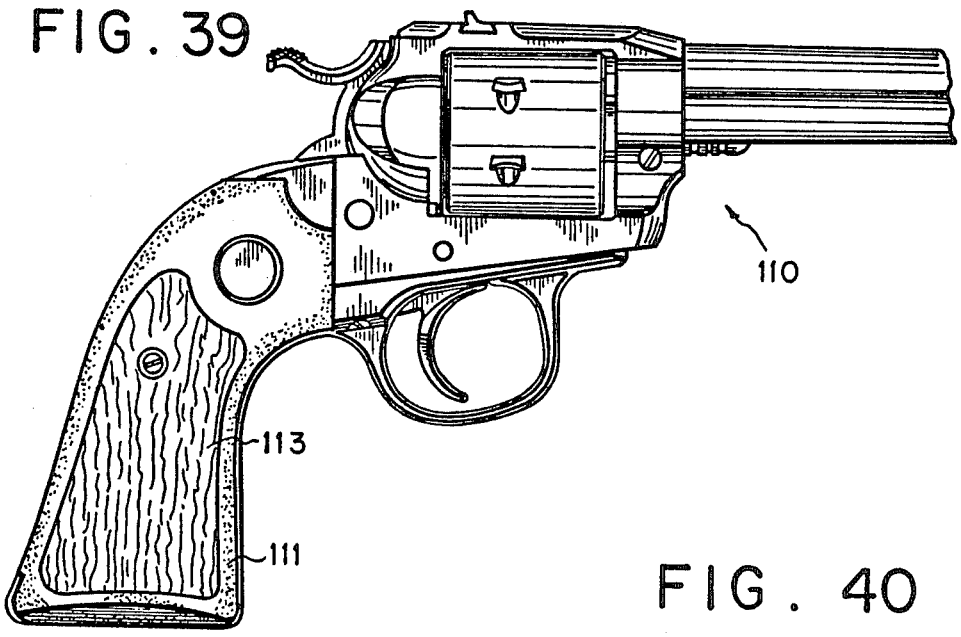
FIG. 39 is a partial left-hand side elevational view of a sixth modification as applied to a revolver.
Figure 40:
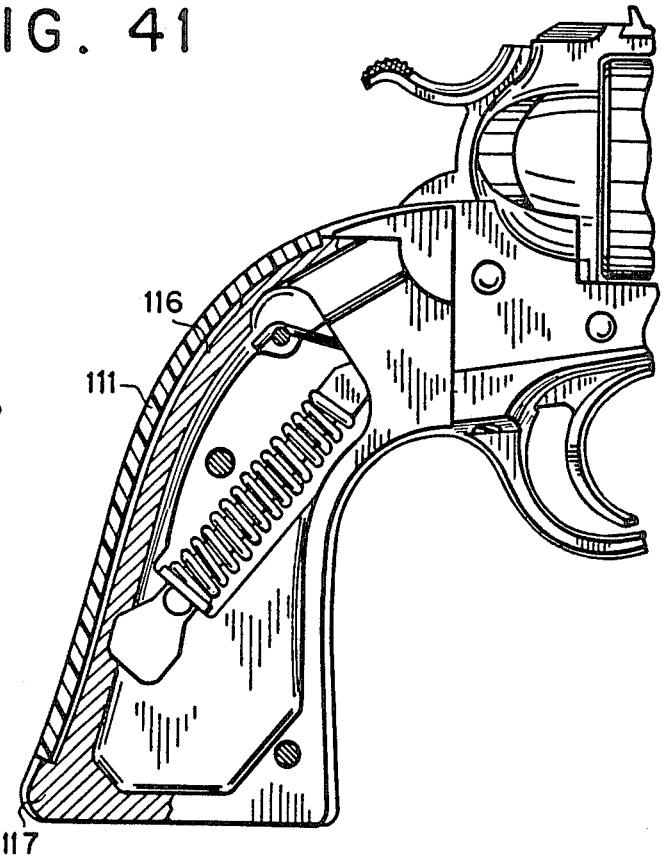
FIG. 40 is a sectional view taken along line 40—40 of FIG. 41.
Figure 41:
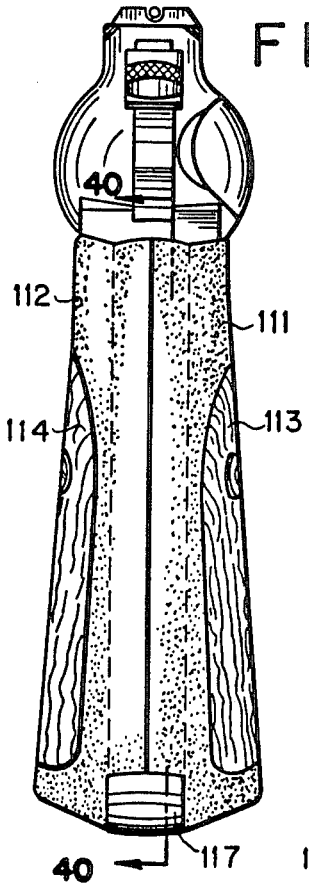
FIG. 41 is a rearward elevational view of the revolver of FIG. 39.
Figure 42:
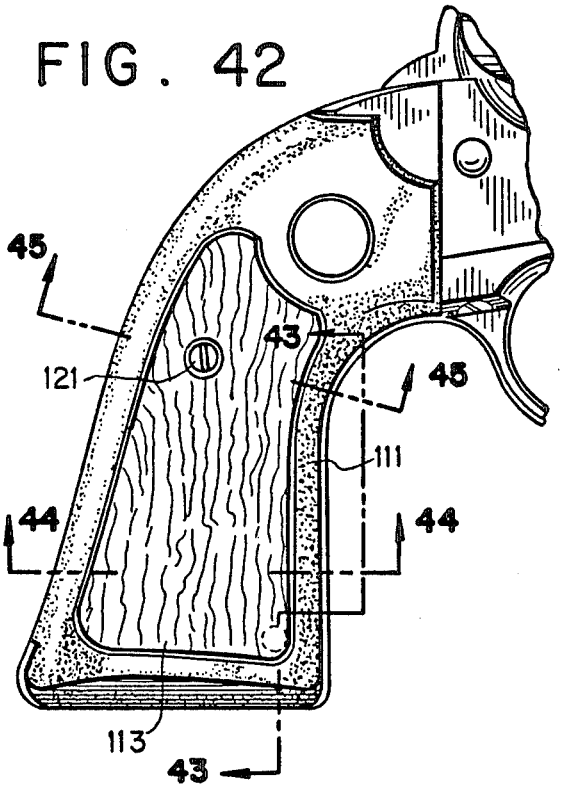
FIG. 42 is a partial elevational left-hand view of the revolver of FIG. 39.
Figure 43:
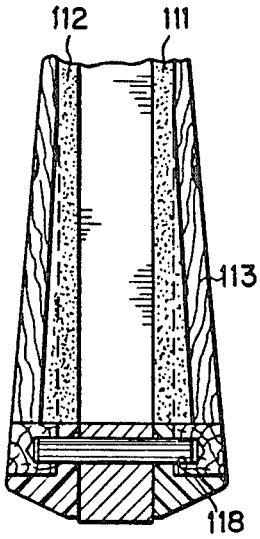
FIG. 43 is a sectional view taken along line 43—43 of FIG. 42.
Figure 44:
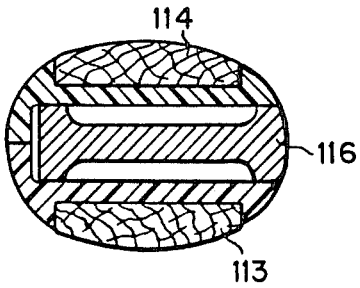
FIG. 44 is a sectional view taken along line 44—44 of FIG. 4I.

FIGS. 35-38 illustrate another embodiment as shown in which revolver 100 has a handle construction simiar to that illustrated in FIG. 11 in that the new grips extend over the revolver's handle with generally the same external contours as the handle. This basic handle type is used on many kinds of revolvers, and FIGS. 35-38 illustrate that this new grip arrangement is adaptable to many guns, such as those manufactured by Smith and Wesson, Colt, Charter Arms, Llama, Taurus, Rossi and others. Also shown are hammer spring 91 and spring anchor piece 92.

Figure 45:
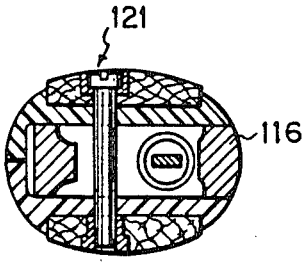
FIG. 45 is a sectional view taken along line 45—45 of FIG. 42.
Figure 46:
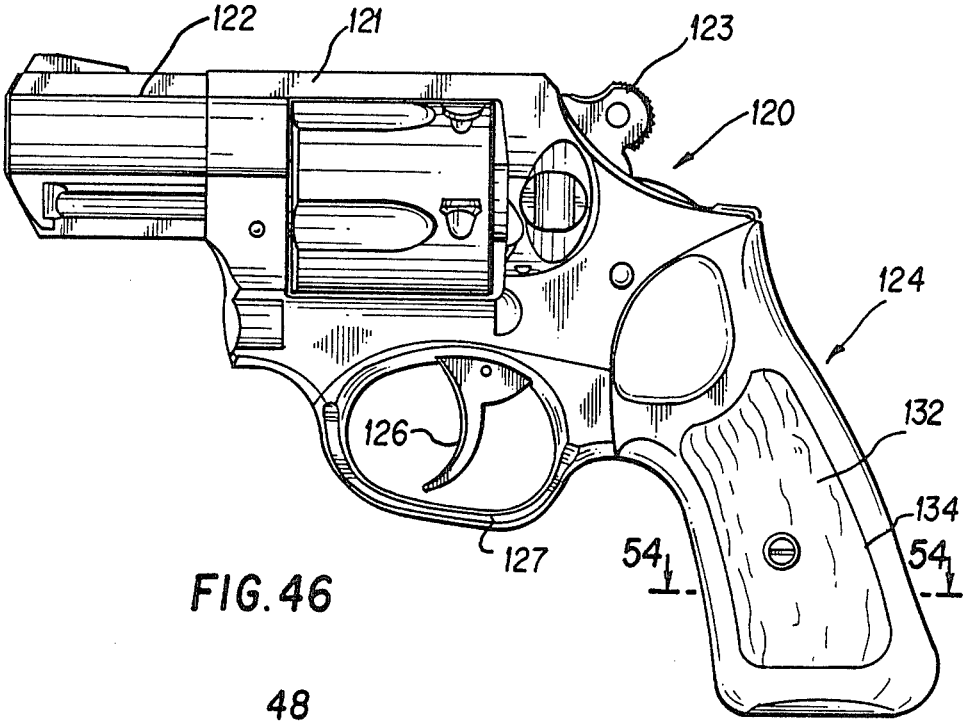
FIG. 46 is a left side partial elevational view of the small revolver.

With respect to Figs. 39-45, revolver 110 includes grip panels 111, 112; inserts 113, II4; grip handle 116 and exposed lower grip handle section 117. Support pin 118 engages grip panels 111, 112 (see FIG. 43) Inserted fastener assembly 121 engages panels 111, 112 to urge them toward frame 116 (FIG. 45). Elastomer element wraps around the rear portion of the grip frame only giving resiliency to that portion and sides only. The front area comprises the grip frame itself.

Figure 47:
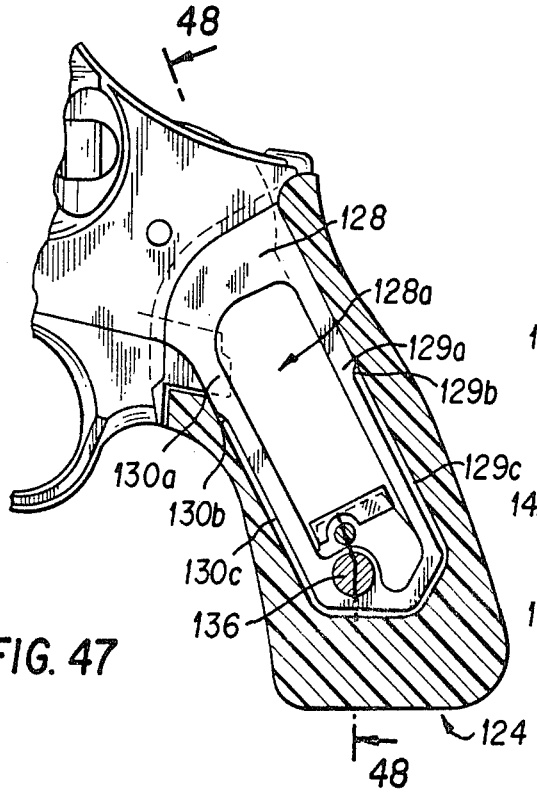
FIG. 47 is a partial left side sectional view of the small revolver.
Figure 55:
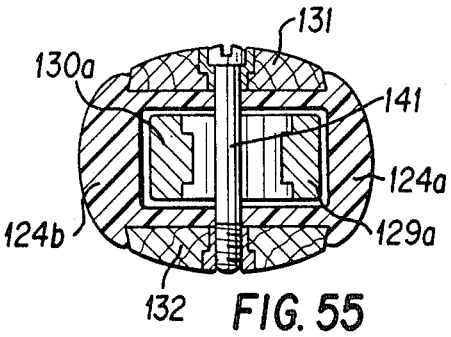
FIG. 55 is a sectional view taken along line 55—55 of FIG. 49.
Figure 52:
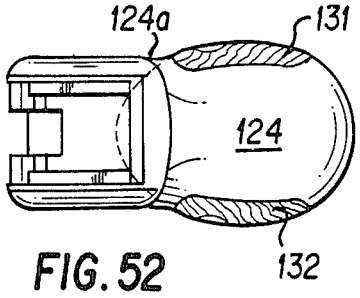
FIG. 52 is a plan view of the grip constrrction.
Figure 49:
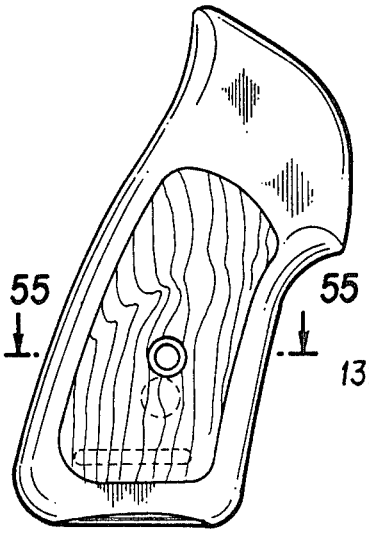
FIG. 49 is a partial right side elevational view of the small revolver grip.
Figure 50:
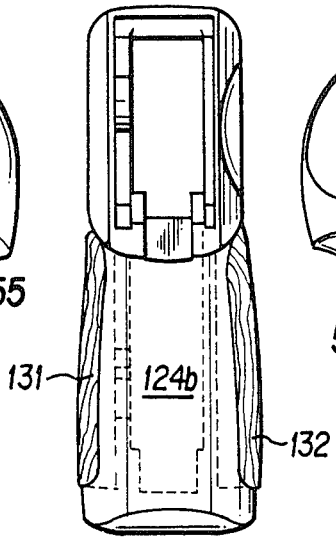
FIG. 50 is an end elevational view of the small revolver handle grip construction.
Figure 51:
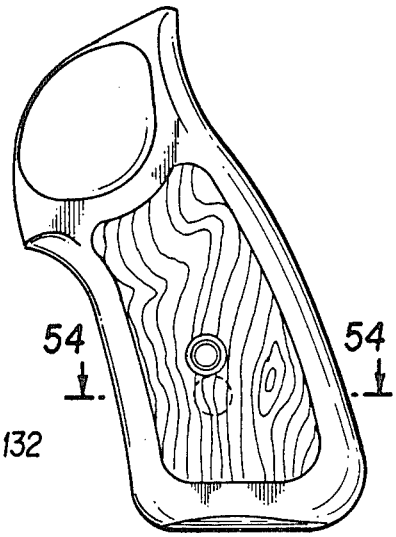
FIG. 51 is a partial left side elevational view of the small revolver grip.
Figure 53:
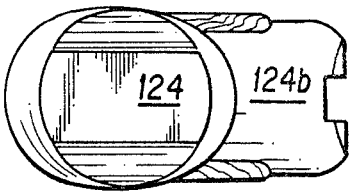
FIG. 53 is a bottom view of the grip construction.
Figure 54:
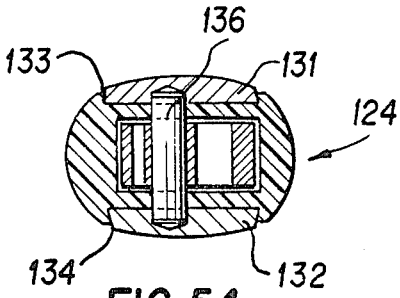
FIG. 54 is a sectional view taken along line 54—54 of FIG. 51.
Figure 56:
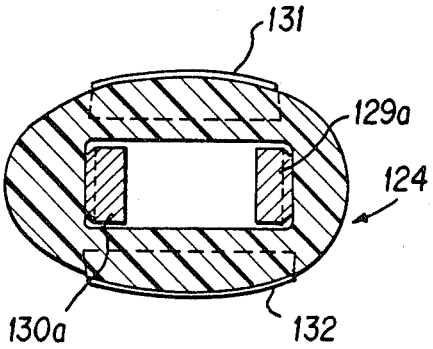
FIG. 56 is a sectional view through grip and handle assembled as shown in FIGS. 57 and 58.

Finally turning to FIGS. 46-60, small revolver 120 includes frame 121, barrel 122, hammer 123, grip panels 124 as integrally formed include spine portion 124*a* and lower connector portion 124*b* (FIG. 55). Also shown are trigger 126, trigger guard 127, and grip frame 128 including rearward frame piece 129*a* with notch 129*b* to form space 129*c* between piece 129*a* and grip panels 124 (FIG. 47) and forward frame piece 130*a* with notch 130*b* to form space 130*c* between piece 130*a* and grip panels 124. Spaces 129*c* and 130*c* provide additional flexibility to the handle system.

Figure 48:
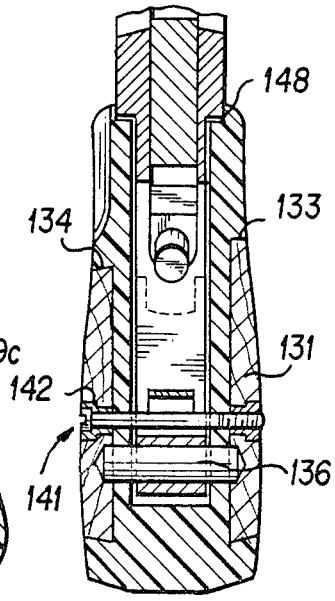
FIG. 48 is a sectional view taken along line 48—48 of FIG. 47.
Figure 60:
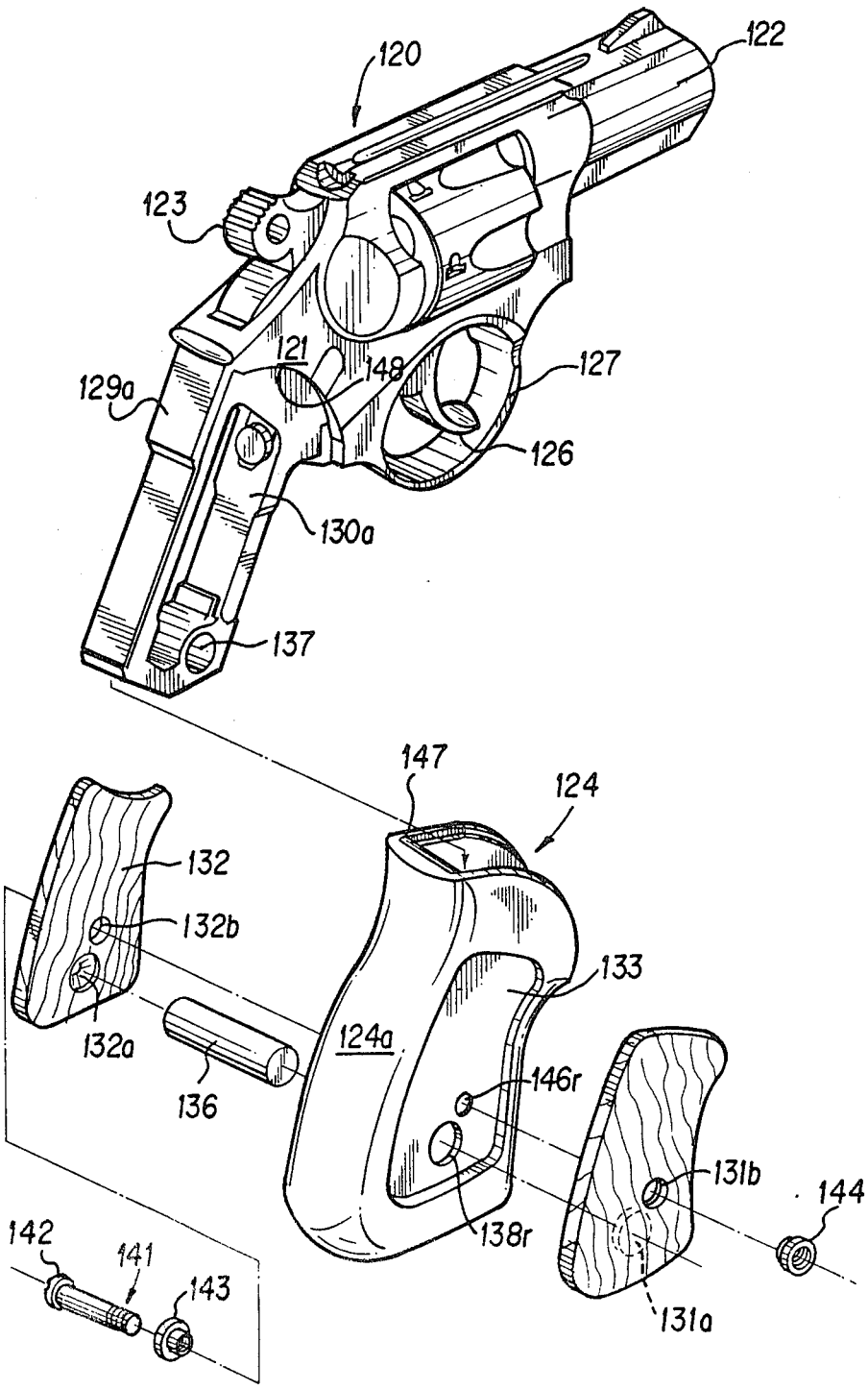
FIG. 60 is an exploded perspective of the small revolver with the grip panel; panel spine; panel inserts and fastener arrangement.

Right and left panel inserts 131, 132 respectively are positioned in right and left grip panel recesses 133, 134 (FIGS. 48, 60). Alignment pin 136 passes through grip frame opening 137; grip panel left and right openings 138*l*, 138*r* (not shown) and the pin ends are nested in insert recesses 131*a*, 132*a* (see FIG. 60).

The fastener arrangement for urging the grip panels 124 against grip frame 128 and also urging grip panels 131, 132, positioned in reoesses 133, 134, against the grip panels 124 includes bolt 141 with bolt head 142, head washer 143 and the threaded end nut 144. By rotating nut 144 to move it toward bolt head 142 panel inserts are moved toward one another compressing flexible grip panels 124. Bolt 141 passes through right insert bolt hole 131*b;* grip panel holes 146*r*, 146*l* and left insert bolt hole 132*b*.

Figure 57:
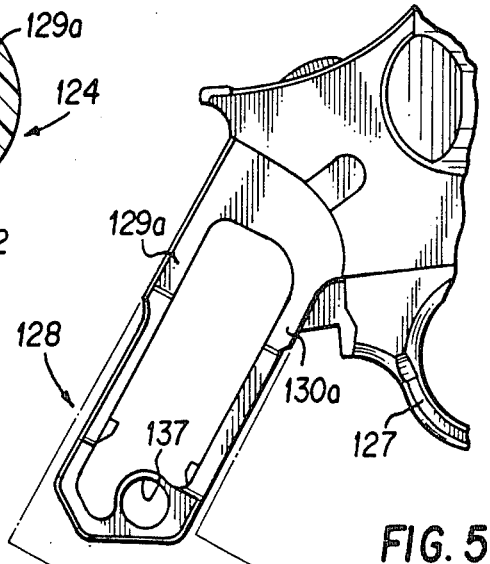
FIG. 57 is a partial left elevational view of the revolver frame.
Figure 59:
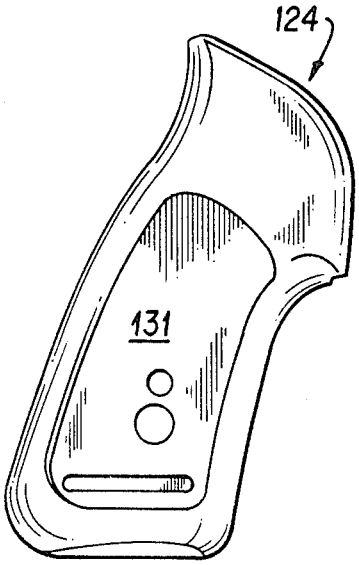
FIG. 59 is a left elevational view of the left side of the grip panel.
Figure 58:
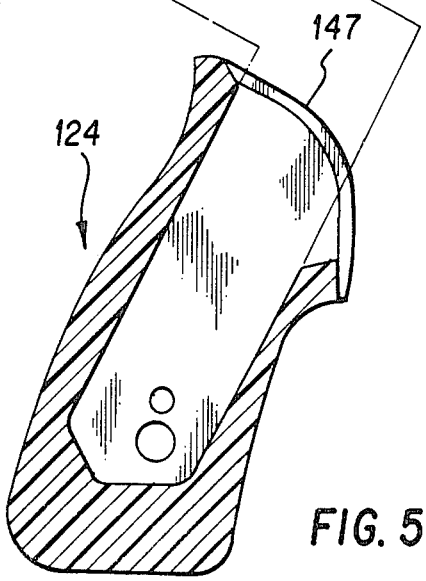
FIG. 58 is a sectional view of an integral grip panel.

Also shown in FIGS. 46–60 is grip panel perimeter notch 147 around the upper end of grip panels 124 to mate with the curved grip frame corner profile 148 (see FIGS. 48 and 60). As seen in FIGS. 57 and 58 grip panels 124 are slidable over grip frame 128 to engage with grip frame 128 with or without stretching or deforming of the elastomer integral grip panels 124. The grip panels 124 are shaped and configured to include spine portion 124*a*. and lower connection portion 124*b*. Portions 124*a*, 124*b* may be separated, fabricated and positioned with respect to the remainder of the grip panels 124 by gluing or other fastener arrangement.

I claim:

1. In a handgun having a handle including a handle frame, the improvement comprising (a) an elastomer grip element integrally formed such that grip means are positioned on each side of the handle frame, said grip means including an inside portion engageable with the handle frame and including an outside portion for engagement with the handgun user's hand;

(b) a recess in the outside poriton of each grip means;

(c) a non-deformable externally inserted stiffening element in each recess, the size and shape of the recesses and stiffening elements being variable to accomplish the desired flexibility-to-stiffness of the handgun handle; and (d) fastener and alignment means for fastening and aligning the grip means, the frame and the stiffening elements.

2. The improvement of claim 1 in which one of said grip means has a second recess in said inside portion with a substantial planar surface which surface is spaced from the handle frame.

3. The improvement of claim 1 in which the handle frame has an opening therein over which the grip means extend.

4. The improvement of claim 1 in which the fastener means includes a threaded fastener which engages each stiffening element, passes through the grip means and engages the handle frame.

5. The improvement of claim 1 in which said grip element includes two grip means and a spine portion integrally formed and shaped to be slidably engaged with the handle frame.

6. The improvement of claim 1 in which the frame carries stabilizing abutment surfaces and in which one of said elastomer grip means has a hole in it and stud means on the handle frame enter into such grip means hole to stabilize the grip means on the handle frame in conjunction with stabilizing abutment surfaces on the handgun handle.

* * * * *